US012669019B2

(12) United States Patent
Johnson et al.

(10) Patent No.: US 12,669,019 B2
(45) Date of Patent: Jun. 30, 2026

(54) INCREASED DRILL BIT OR LOWER BHA INERTIA FOR REDUCING HFTO

(71) Applicant: Schlumberger Technology Corporation, Sugar Land, TX (US)

(72) Inventors: Ashley Bernard Johnson, Milton (GB); David Scott, Huntingdon (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/063,382

(22) Filed: Feb. 26, 2025

(65) Prior Publication Data

US 2025/0277411 A1 Sep. 4, 2025

Related U.S. Application Data

(60) Provisional application No. 63/559,438, filed on Feb. 29, 2024.

(51) Int. Cl.
*E21B 12/04* (2006.01)
*E21B 7/06* (2006.01)
*E21B 10/567* (2006.01)

(52) U.S. Cl.
CPC ..... *E21B 12/04* (2013.01); *E21B 7/064* (2013.01); *E21B 10/567* (2013.01); *E21B 2200/20* (2020.05)

(58) Field of Classification Search
None
See application file for complete search history.

(56) References Cited

U.S. PATENT DOCUMENTS 3,298,451 A * 1/1967 Eckel ..... E21B 10/602 D15/21
4,873,895 A * 10/1989 Taylor ..... E21B 10/62 76/108.2
6,327,539 B1 * 12/2001 Keultjes ..... E21B 44/00 73/152.43

(Continued)

FOREIGN PATENT DOCUMENTS

WO WO-2021050334 A1 * 3/2021 ..... F16F 15/1207

OTHER PUBLICATIONS

Johnson, A. et al., "Characterizing Drilling Dysfunction: Taking the T Out of HFTO", Paper presented at the IADC/SPE International Drilling Conference and Exhibition, SPE-208720-MS, Mar. 1, 2022, pp. 1-15.

*Primary Examiner* — Blake Michener
(74) *Attorney, Agent, or Firm* — Jeffrey D Frantz

(57) ABSTRACT

A method for estimating and reducing high-frequency torsional oscillations (HFTO) during a downhole drilling operation includes estimating an HFTO propensity of an initial BHA configuration using a model that relates the HFTO propensity to at least a rock strength of a subterranean formation, a radius or diameter of the borehole, a drill bit body density, and a drill bit body radius or diameter. The estimated HFTO propensity is compared with an HFTO propensity threshold. The model is used to select a modified drill bit or bottom hole assembly (BHA) configuration that reduces the estimated HFTO propensity to a value below the HFTO propensity threshold. The modified drill bit or BHA configuration has an increased polar moment of inertia as compared to the initial drill bit or BHA configuration.

20 Claims, 5 Drawing Sheets

(56) References Cited

U.S. PATENT DOCUMENTS

| | | | | |
|---|---|---|---|---|
| 7,020,597 | B2 * | 3/2006 | Oliver | E21B 44/00 175/45 |
| 11,603,714 | B2 * | 3/2023 | Reckmann | E21B 4/003 |
| 2005/0056463 | A1 * | 3/2005 | Aronstam | E21B 10/62 175/73 |
| 2007/0067147 | A1 * | 3/2007 | Huang | E21B 10/00 703/7 |
| 2015/0122547 | A1 * | 5/2015 | Hohl | E21B 44/02 175/40 |
| 2020/0003009 | A1 * | 1/2020 | Caresta | E21B 7/068 |
| 2020/0018377 | A1 * | 1/2020 | Hohl | F16F 15/1207 |
| 2021/0079737 | A1 * | 3/2021 | Peters | E21B 17/042 |
| 2022/0403731 | A1 * | 12/2022 | Johnson | E21B 17/1078 |
| 2024/0052740 | A1 * | 2/2024 | Johnson | E21B 47/085 |
| 2025/0059875 | A1 * | 2/2025 | Johnson | E21B 44/00 |
| 2025/0084752 | A1 * | 3/2025 | Johnson | E21B 44/04 |

* cited by examiner

INCREASED DRILL BIT OR LOWER BHA INERTIA FOR REDUCING HFTO

CROSS REFERENCE TO RELATED APPLICATIONS

This application claims priority to U.S. Provisional Patent Application No. 63/559,438 which was filed on Feb. 29, 2024 and is incorporated herein by reference in its entirety.

BACKGROUND

Severe dynamic conditions are often encountered while drilling subterranean wellbores (e.g., for oil and gas exploration and production and geothermal wells). Such dynamic conditions may include axial vibrations including bit bounce, lateral vibrations including whirl, and torsional vibrations including stick slip and high frequency torsional oscillations (HFTO). HFTO can be highly destructive, particularly to the drill bit and lower bottom hole assembly (BHA). Acute HFTO may lead to severe component and connection fatigue and even to catastrophic failure of the BHA.

Despite its highly destructive potential, HFTO is not well understood. Mitigation efforts have attempted to reduce HFTO amplitude or to dampen HFTO vibrations. For example, some mitigation efforts have attempted to develop balanced drill string components that are less inclined to induce HFTO or to identify drilling parameters that reduce HFTO tendency. Other mitigation efforts have employed a vibration suppressor tool in the BHA to dampen HFTO and thereby reduce the damaging effects of the HFTO. Despite these efforts, HFTO remains a challenging and often destructive problem. There is a need to better understand HFTO mechanisms to provide drill bit and BHA components that are less susceptible to such damaging oscillations.

SUMMARY

A method for estimating and reducing high-frequency torsional oscillations (HFTO) during a downhole drilling operation is disclosed. An initial BHA configuration is provided. An HFTO propensity of the initial BHA configuration is estimated using a model that relates the HFTO propensity to at least a rock strength of a subterranean formation, a radius or diameter of the borehole, a drill bit body density, and a drill bit body radius or diameter. The estimated HFTO propensity is compared with an HFTO propensity threshold. When the estimated HFTO propensity exceeds the HFTO propensity threshold the model is used to select a modified drill bit or bottom hole assembly (BHA) configuration that reduces the estimated HFTO propensity to a value below the threshold. The modified drill bit or BHA configuration has an increased polar moment of inertia as compared to the initial drill bit or BHA configuration.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

A method for estimating and reducing high-frequency torsional oscillations (HFTO) during a downhole drilling operation is disclosed. An initial BHA configuration is provided. An HFTO propensity of the initial BHA configuration is estimated using a model that relates the HFTO propensity to at least a rock strength of a subterranean formation, a radius or diameter of the borehole, a drill bit body density, and a drill bit body radius or diameter. The estimated HFTO propensity is compared with an HFTO propensity threshold and the model is used to select a modified drill bit or bottom hole assembly (BHA) configuration that reduces the estimated HFTO propensity to a value below the threshold. The modified drill bit or BHA configuration has an increased polar moment of inertia as compared to the initial drill bit or BHA configuration.

In example embodiments, a selected BHA may include a fixed blade polycrystalline diamond compact (PDC) drill bit including an upper pin end configured for coupling with a lower BHA tool. The PDC drill bit may be selected to have a gauge diameter dependent polar moment of inertia that is greater than a predetermined gauge diameter dependent inertia threshold such that the BHA exhibits an HFTO propensity that is below a corresponding HFTO threshold. In other example embodiments, a modified BHA (modified for reducing a susceptibility to HFTO) may have a polar moment of inertia that is at least 25% (or even 50%) greater than a polar moment of inertia of the BHA prior to the modification.

Figure 1:
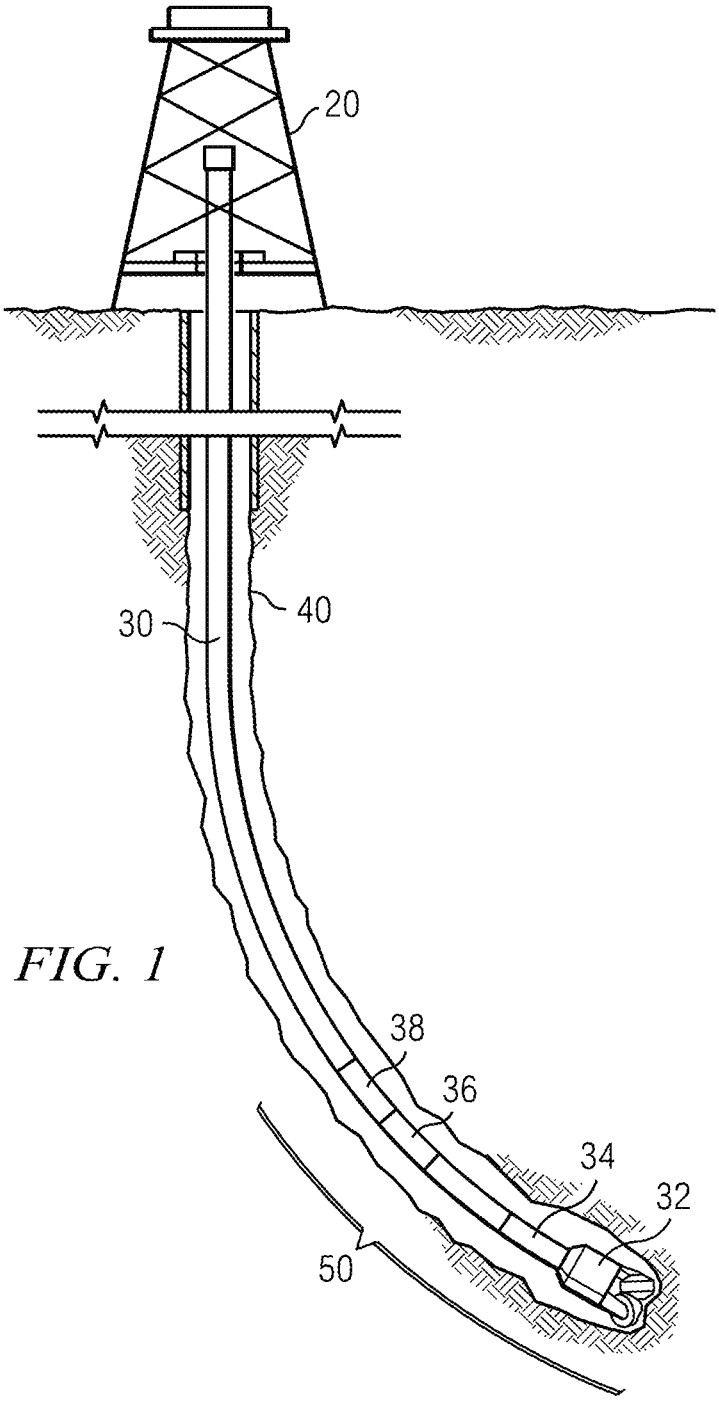
FIG. 1 depicts an example drilling rig suitable for drilling a wellbore.

FIG. 1 depicts a schematic drilling rig 20 including a drill string 30 and bottom hole assembly 50 deployed in the string and disposed within a wellbore 40. The drilling rig 20 may be deployed in either onshore or offshore applications (an onshore application is depicted). Moreover, the wellbore may be inclined at substantially any angle and may include vertical, horizontal, and building sections (only vertical and building sections are depicted). The disclosed embodiments are not limited to any particular wellbore configuration. In the depicted example, the wellbore 40 may be formed in subsurface formations by rotary drilling in a manner that is well-known to those or ordinary skill in the art (e.g., via well-known directional drilling techniques).

As is known to those of ordinary skill, the drill string 30 may be rotated, for example, at the surface to drill the well (e.g., via a rotary table) or via a hydraulically powered motor deployed in or above the BHA 50. A pump may deliver drilling fluid through the interior of the drill string 30 to the drill bit 32 where it exits the string via ports therein. The fluid may then circulate upwardly through the annular region between the outside of the drill string 30 and the wall of the wellbore 40. In this known manner, the drilling fluid lubricates the drill bit 32 and carries formation cuttings up to the surface.

In the illustrated example embodiment, the BHA 50 may include any number of downhole tools, for example, including a steering tool 34 (such as a rotary steerable system), a logging while drilling (LWD) tool 36 and a measurement while drilling (MWD) tool 38. The steering tool 34, the LWD tool 36, and/or the MWD tool 38 may optionally include one or more sensors, such as magnetometers and/or accelerometers, that are configured to identify and or quantify BHA vibrations. The BHA may further include one or more stabilizers as well as other tools such as a reamer. The disclosed embodiments are not limited to any particular BHA configuration.

As described above in the Background section, HFTO can cause severe damage to the BHA and drill bit, including catastrophic failure. One aspect of the disclosed embodiments was the realization that HFTO is often caused by the interaction of the drill bit with the formation such that harder and stiffer formations (such as limestone) often cause more severe HFTO than softer more pliable formations (such as sandstone). In other words, it was realized that the HFTO amplitude is driven by the drill bit (cutter) rock interaction at the damaging frequency, rather than broadband drilling noise. It was still further realized, that damaging HFTO can be significantly reduced by increasing the polar moment of inertia of the drill bit and/or lower BHA components. As described in more detail below, the polar moment of inertia may be increased, for example, by adding large diameter mass to the drill bit or lower BHA or by increasing the density of the material from which the BHA is constructed.

Figure 2A:
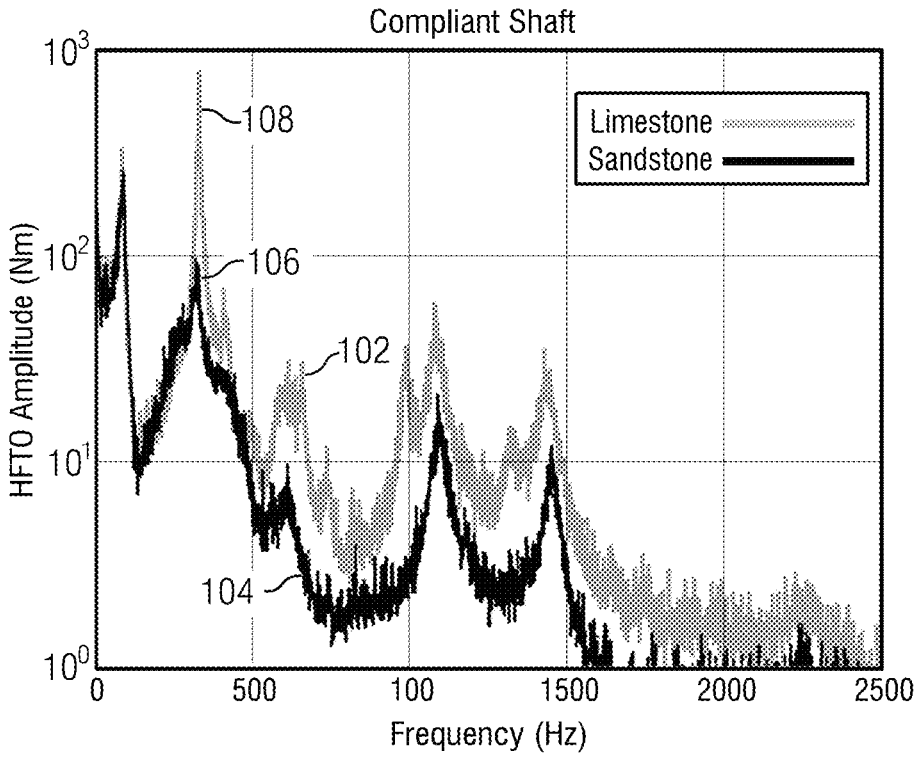
FIGS. 2A and 2B (collectively FIG. 2) depict plots of HFTO amplitude versus frequency.
Figure 2B:
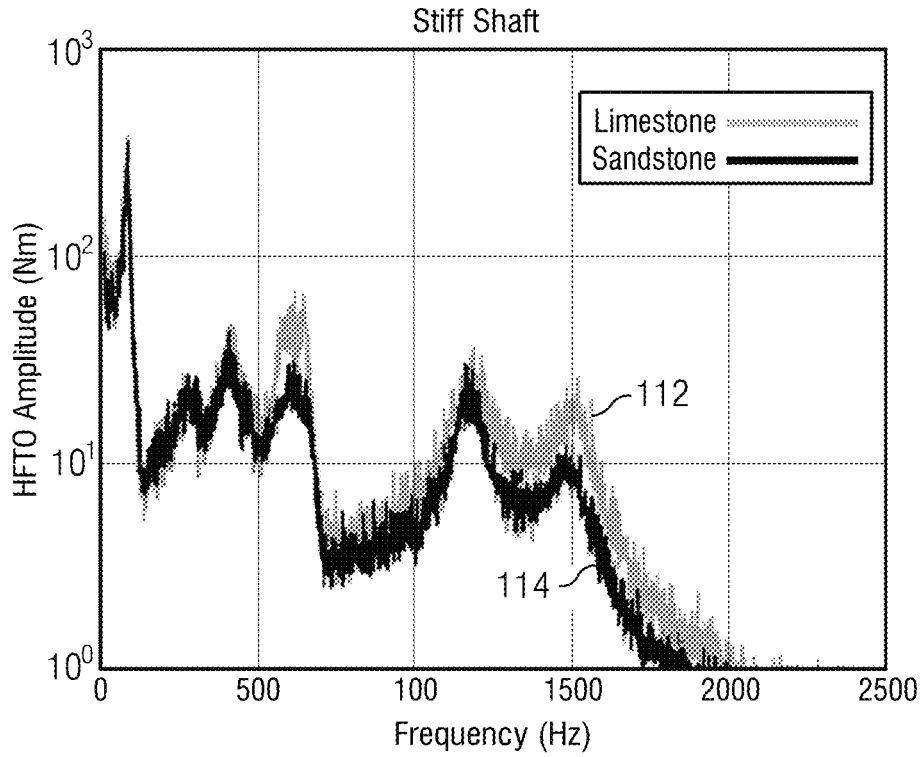

Turning now to FIGS. 2A and 2B (collectively FIG. 2), plots of HFTO amplitude versus frequency are depicted. FIG. 2A depicts first and second sonograms of shaft torque amplitude as measured in a laboratory drilling machine with an HFTO enabled "compliant" shaft. FIG. 2B depicts corresponding first and second sonograms of shaft torque amplitude as measured in the same laboratory drilling machine with an HFTO disabled "non-compliant" shaft. In FIGS. 2A and 2B, the first sonograms 102, 112 were obtained while drilling a limestone formation and the second sonograms 104, 114 were obtained while drilling a sandstone formation. In these experiments, the HFTO occurs at about 300 Hz. In FIG. 2A, note that the HFTO amplitude in the spike 108 (of the first sonogram 102) is nearly an order of magnitude greater than the HFTO amplitude of the spike 106 (of the second sonogram 104). In particular, note that the HFTO had a much higher amplitude when drilling the comparatively stiff limestone formation, thereby indicating that HFTO oscillations can be induced (or amplified) by the interaction between the drill bit and the formation rock.

Figure 3B:
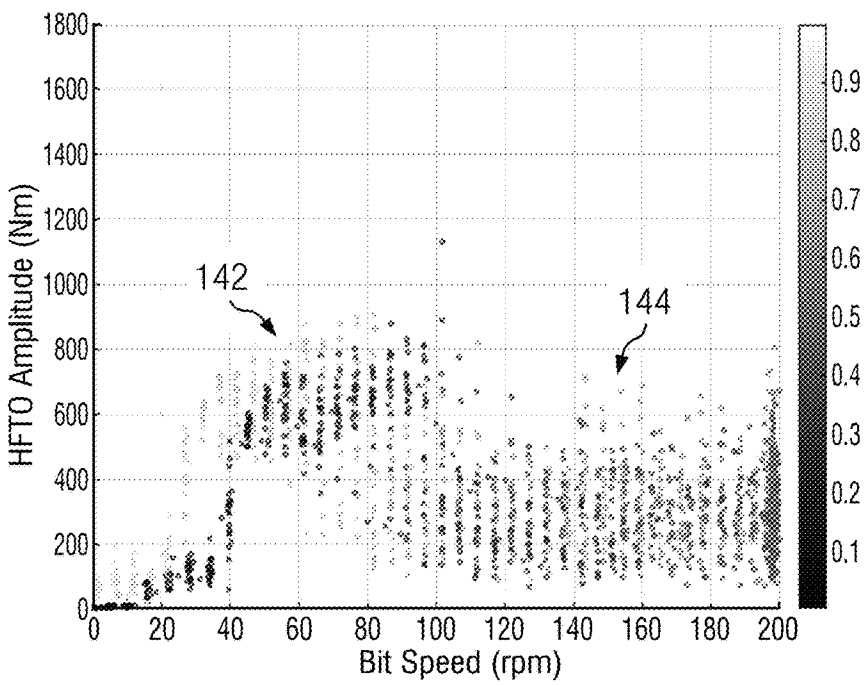
FIGS. 3A and 3B (collectively FIG. 3) depict plots of HFTO amplitude versus drill bit rotation rate.
Figure 3B:
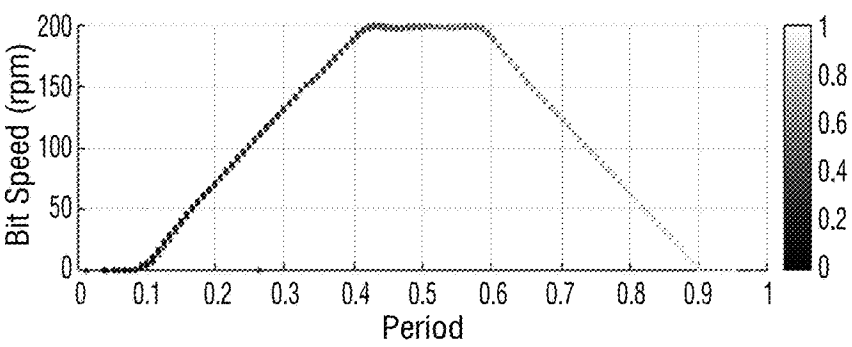
Figure 3A:
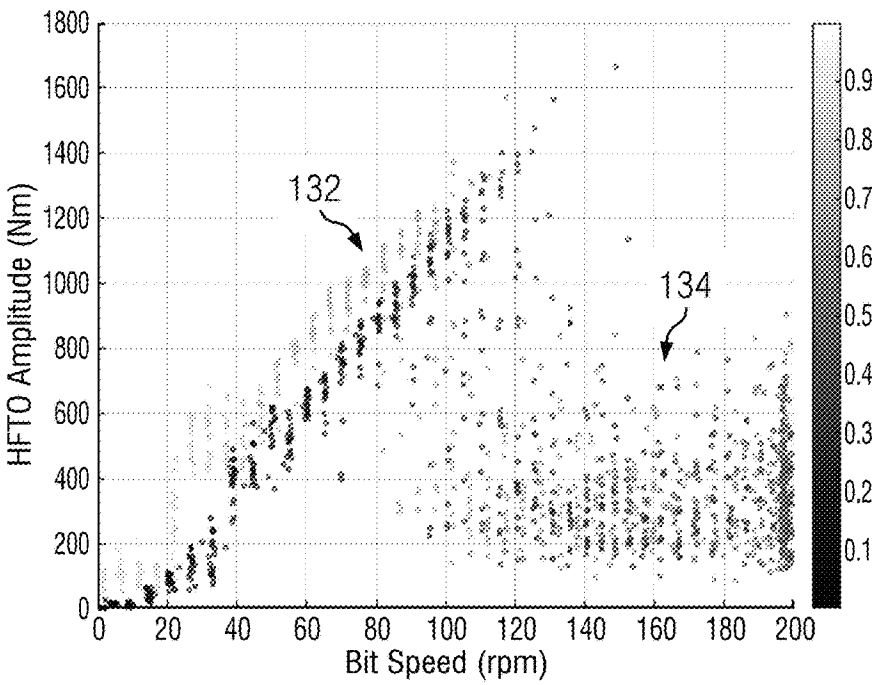
Figure 3A:
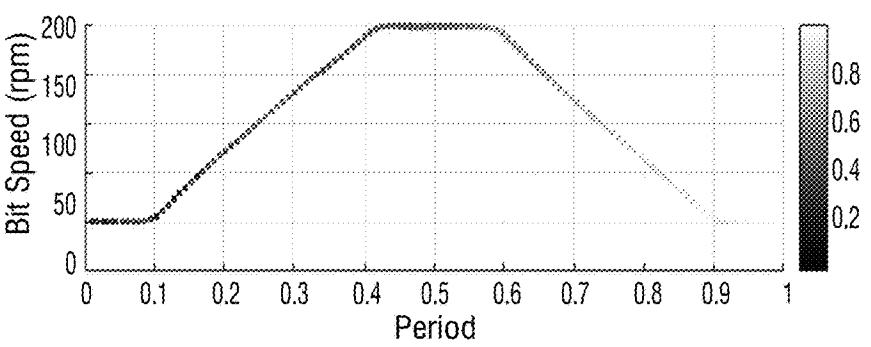

FIGS. 3A and 3B depict plots of HFTO amplitude versus drill bit rotation rate for first and second drill bits. In each plot, the HFTO amplitude was characterized using a repeated RPM sweep. The first drill bit was a conventional steel body polycrystalline diamond (PDC) fixed blade drill bit (the AccuStrike 613 having a gauge diameter of 6.75 inches and available from SLB). The first drill bit had a polar moment of inertia of about 102 $lb \cdot in^2$ (0.030 $kg \cdot m^2$). The second drill bit included the same conventional steel body PDC fixed blade bit, but was modified with the addition of an annular mass having a moment of inertia of about 55 $lb \cdot in^2$ (0.016 $kg \cdot m^2$) deployed about a lower end of the drill bit shaft (such that the bit had a total moment of inertia of about 157 $lb \cdot in^2$ (0.046 $kg \cdot m^2$). In each plot the HFTO amplitude data is color-coded to indicate the drill bit RPM.

In FIG. 3A, the conventional steel body drill bit experiences large amplitude HFTO (up to and exceeding 1500 Nm) at the intermediate drill bit rotation rates (about 100 RPM). The plot further indicates that there are two states of HFTO in this experiment; a high level ramp 132 up to about 1500 Nm and a lower level 134. The higher level 132 exhibits approximately linearly increasing HFTO with increasing drill bit rotation rate up to about 120 rpm. The HFTO then drops significantly (e.g., by a factor of about 2 to about 4) to the lower level at higher rotation rates. This lower level is substantially independent of the drill bit rotation rate and varies from about 150 to about 800 Nm. As the drill bit rotation rate decreases from the maximum, the HFTO remains at the lower level until about 90 rpm where it jumps up to the higher level.

In FIG. 3B, the modified steel body drill bit (having the higher inertia) experiences significantly different HFTO behavior. The highest observed HFTO was about 800 Nm at a drill bit rotation rate of about 90 rpm. Moreover, the HFTO amplitude is essentially independent of the drill string rotation rate between about 40 and 90 rpm as indicated at 142. It is evident that the added inertial mass reduced the maximum HFTO amplitude by about 50%. Above the drill bit rotation rate of about 90 rpm, a lower level HFTO amplitude was observed as indicated at 144. As with the first drill bit, this lower level was substantially independent of the drill bit rotation rate and ranged from an HFTO amplitude of about 100 to about 600 Nm (which also represents a reduction in HFTO amplitude).

Based on the foregoing, it will be appreciated that increasing the moment of inertia of a steel body drill bit may decrease high amplitude HFTO during drilling or decrease the susceptibility of the bit to inducing high amplitude HFTO. Disclosed embodiments may therefore include steel body drill bits having a high or increased moment of inertia. For example only, for a drill bit having a gauge diameter of 6.75 inch (17 cm), the disclosed steel body drill bits may have a moment of inertia greater than 130 $lb \cdot in^2$ (0.038 $kg \cdot m^2$), for example, greater than 140 $lb \cdot in^2$ (0.041 $kg \cdot m^2$), greater than 150 $lb \cdot in^2$ (0.044 $kg \cdot m^2$), greater than 160 $lb \cdot in^2$ (0.047 $kg \cdot m^2$), greater than 170 $lb \cdot in^2$ (0.050 $kg \cdot m^2$), greater than 180 $lb \cdot in^2$ (0.053 $kg \cdot m^2$), or even greater than 200 $lb \cdot in^2$ (0.059 $kg \cdot m^2$).

Moreover the disclosed embodiments may further include modified drill bits (e.g., modified steel body drill bits), in which an annular mass has been added to the bit to increase the moment of inertia of the modified bit (such as to a lower shaft portion of the bit or to the blades). For example only, for a drill bit having a gauge diameter of 6.75 inch (17 cm), the modified drill bit may also have a moment of inertia greater than 130 $lb \cdot in^2$ (0.038 $kg \cdot m^2$), for example, greater than 140 $lb \cdot in^2$ (0.041 $kg \cdot m^2$), greater than 150 $lb \cdot in^2$ (0.044 $kg \cdot m^2$), greater than 160 $lb \cdot in^2$ (0.047 $kg \cdot m^2$), greater than 170 $lb \cdot in^2$ (0.050 $kg \cdot m^2$), greater than 180 $lb \cdot in^2$ (0.053 $kg \cdot m^2$), or even greater than 200 $lb \cdot in^2$ (0.059 $kg \cdot m^2$).

It will of course be appreciated, that the disclosed embodiments are not limited to having any particular moment of inertia value. In particular, it will be appreciated that commercial drill bits are constructed in a wide range of sizes (e.g., ranging from a gauge diameter of less than 6 inches to a gauge diameter of greater than 12 inches) and that an advantageous moment of inertia will depend on the size (gauge diameter) of the drill bit. The moment of inertia of a cylinder increases with the diameter of the cylinder raised to the fourth power. It is expected that the desired moment of inertia of a drill bit increases similarly (although somewhat less than a cylinder). In the example embodiments, the moment of inertia of a steel body drill bit may be greater than a diameter dependent threshold (a steel body drill bit diameter dependent threshold). In other example embodiments, the moment of inertia of a matrix body drill bit may be greater than another diameter dependent threshold (a matrix body drill bit diameter dependent threshold).

Moreover, it will be appreciated that the desired moment of inertia may also depend on the number of blades (also referred to as wings) and the number of cutting elements per blade on the drill bit. As described above, HFTO can be induced by the drill bit rock interaction. Therefore, while the disclosed embodiments are not limited in this regard, it might be expected that the desired moment of inertia may increase with an increasing number of cutting elements on the drill bit or on each blade. Moreover, the desired moment of inertia may also depend on the configuration (e.g., size and shape) of each of the cutting elements as well as of the blades themselves.

The disclosed embodiments may still further include a lower BHA, for example, including a drilling system including a rotary steerable tool and a drill bit. In such embodiments, the rotary steerable tool may be configured or modified such that it has a high moment of inertia. For example, a high moment mass may be deployed on a lower portion of the rotary steerable tool, such as about the bias unit.

As is known to those of ordinary skill in the art, many drill string tools and components, for example, including rotary steerable tools and even drill bits can be thought of as being hollow cylinders or having a hollow cylinder-like construction. The moment of inertia of a hollow cylinder can may be expressed mathematically, for example, as follows:

$$I = \frac{1}{8}M(D_O^2 + D_I^2)$$

where I represents the moment of inertia, M represents the mass, and $D_o$ and $D_I$ represents the outer and inner diameters of the cylinder. The moment of inertia may also be expressed in terms of the material density of the cylinder, for example, as follows:

$$I = \frac{1}{32}\rho(D_O^4 - D_I^4)L$$

where ρ represents the density and L represents the length of the cylinder or cylindrical portion of the tool. As is evident from the foregoing equations, the moment of inertia of a drill bit (or other drilling tool) may be increased using one or more of several strategies. For example, the moment of inertia of the drill bit may be increased by increasing the density of the material construction of the bit body. While replacing the high-strength steel in the bit body with a tungsten carbide (referred to in the industry as matrix) significantly increases the moment of inertia of the drill bit, such drill bits are significantly more expensive than steel body bits. There remains a need in the industry for lower cost steel body drill bits having an increased moment of inertia.

The moment of inertia may also be increased by increasing the outer diameter of the drill bit. While it is not practical (or possible) to increase the diameter of the bit itself (since it is this gauge diameter that defines the diameter of the wellbore), the diameter of other portions of the drill bit or lower BHA may be increased. Moreover, a high mass cylinder or sleeve may be deployed about the shaft just above the bit in the bit pin or alternatively in the lower BHA (e.g., about the bias unit in a rotary steerable tool). Such a sleeve may be constructed from a high-strength steel or tungsten carbide to achieve an even greater increase in the moment of inertia.

Figure 4A:
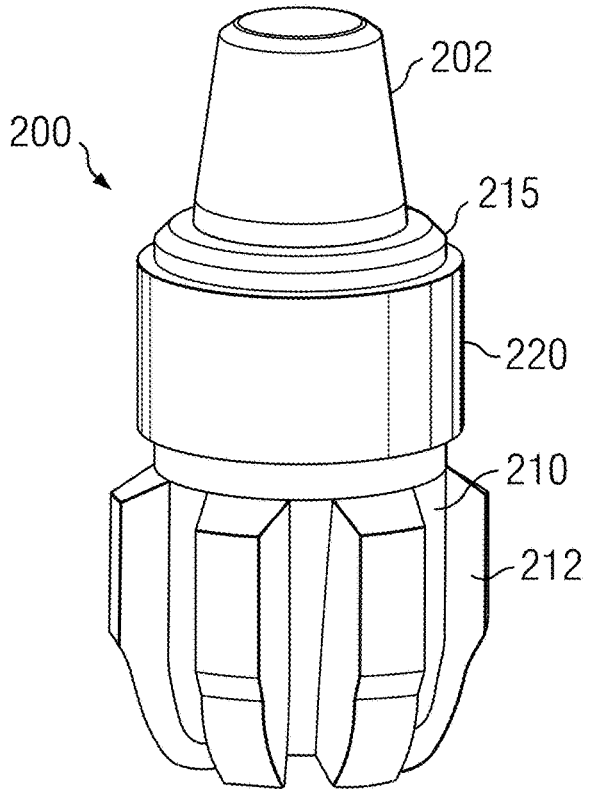
FIGS. 4A and 4B (collectively FIG. 4) depict example steel body drill bits configured to have an increased moment of inertia.
Figure 4B:
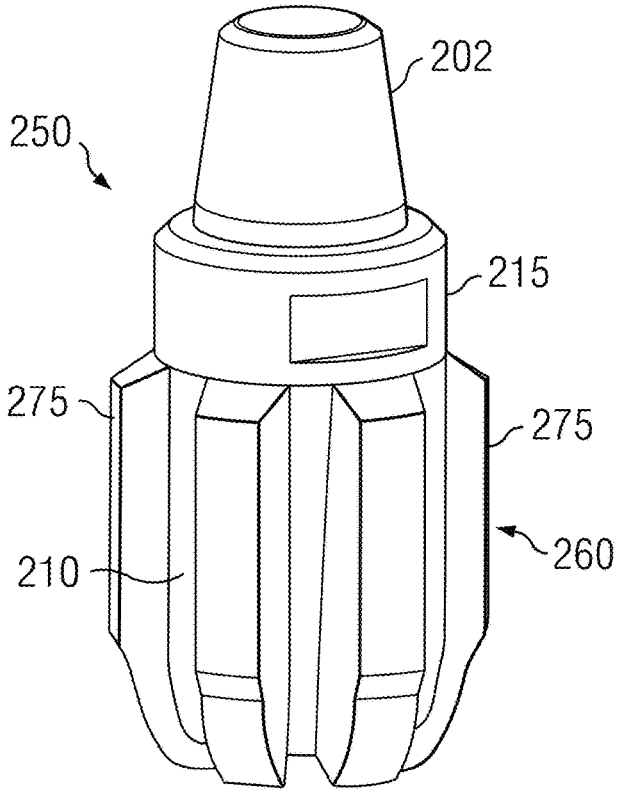

FIGS. 4A and 4B (collectively FIG. 4) depict example steel body drill bits 200 and 250 configured to have an increased moment of inertia. In FIG. 4A drill bit 200 is a fixed blade PDC drill bit in which a plurality of cutting elements are deployed on each of the bit blades 212. The drill bit 200 includes a steel (e.g., a high-strength steel) drill bit body 210 and a plurality of the bit blades 212 extending radially outward from the bit body 210. The drill bit 200 further includes an upper pin end 202 configured for coupling with the lower BHA, for example, a rotary steerable tool in many BHA embodiments. Drill bit 200 further includes a sleeve (or ring) deployed about a lower portion of the bit body or shaft 215. The sleeve 220 may be constructed from high-strength steel (similar to the bit body 210) or a higher density material such as tungsten carbide. As described above, the sleeve is intended to increase the moment of inertia of the drill bit 200. The sleeve may be coupled to the bit 200 or shaft 215 using techniques known to those of ordinary skill, for example via threading, pinning, screwing, or welding. The disclosed embodiments are not limited in these regards. In advantageous embodiments the sleeve 220 may increase the moment of inertia of the drill bit by at least 20% (e.g., at least 25%, at least 30%, at least 40%, or at least 50%).

In FIG. 4B drill bit 250 is also a fixed blade PDC drill bit in which a plurality of cutting elements are deployed on each of the bit blades 260. The drill bit 250 includes a steel (e.g., a high-strength steel) drill bit body 210 and a plurality of the bit blades 260 extending radially outward from the bit body 210. The drill bit 250 further includes an upper pin end 202 configured for coupling with the lower BHA, for example, a rotary steerable tool in many BHA embodiments. In this particular embodiment, drill bit 250 includes extended blades 260 or blade extenders 275. The extended blades 260 have an increased length (as compared to conventional blades) such that they extend further up the side of the drill bit 250. In example embodiments the extended blades may be of a unitary construction or in alternative embodiments the extended blades may include blade extenders 275 that are coupled (e.g., welded or otherwise affixed) to the bit body 210 or shaft 215. The blade extenders 275 may (or may not) include cutting elements and may be fabricated from substantially any suitable material of construction (e.g., high-strength steel or tungsten carbide). As described above, the extended blade or blade extenders are intended to increase the moment of inertia of the drill bit 250. The disclosed embodiments are not limited in these regards. In advantageous embodiments the extended blade or blade extenders may increase the moment of inertia of the drill bit by at least 20% (e.g., at least 25%, at least 30%, at least 40%, or at least 50%).

Figure 5:
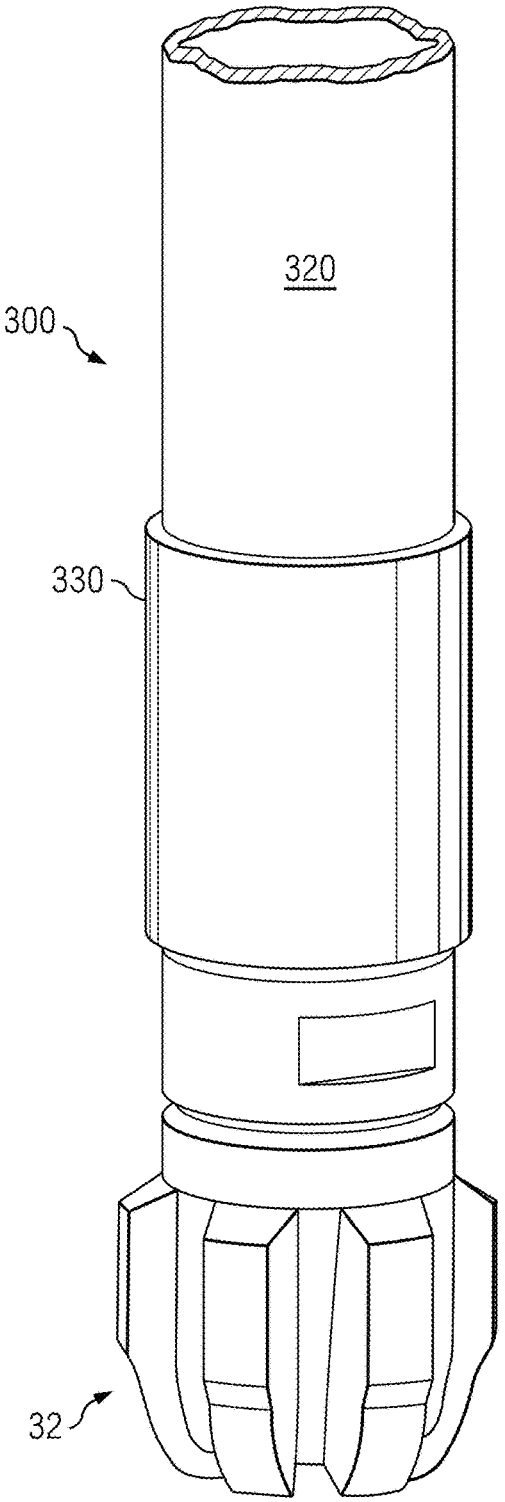
FIG. 5 depicts a lower BHA including a steel body fixed blade drill bit coupled with a rotary steerable tool.

FIG. 5 depicts a lower BHA 300 including a steel body fixed blade drill bit 32 coupled with a rotary steerable tool 320. In the depicted embodiment, a sleeve (or ring) 330 is deployed about a lower portion of the rotary steerable tool 320. The sleeve 330 may be constructed from high-strength steel (similar to the drill collar) or a higher density material such as tungsten carbide. The sleeve may be coupled to the bit 200 or shaft 215 using techniques known to those of ordinary skill, for example via threading, pinning, screwing, or welding. The disclosed embodiments are not limited in these regards. As described above, the sleeve 330 is intended to increase the moment of inertia of the drill bit 200. In advantageous embodiments the sleeve 330 may increase the moment of inertia of the lower BHA by at least 20% (e.g., at least 25%, at least 30%, at least 40%, or at least 50%).

With continued reference to FIG. 5, and in alternative embodiments, rotary steerable tool 320 may be constructed with a larger outer diameter. In such embodiments the diameter of the rotary steerable tool 320 may be increased by about 5% (e.g., by about 10% or by about 15%). In such embodiments, the difference between the drill bit gauge diameter in the outer diameter of the rotary steerable tool may be less than about 2 inches (e.g., less than about 1.5 inches, less than about 1.25 inches, or even less than about 1 inch). For example, in embodiments employing a drill bit having a gauge diameter of 6.75 inches, the outer diameter of the lower BHA may be about 5.5 inches or greater.

It will be further appreciated that while the disclosed embodiments are described above with respect to steel body drill bits, that the disclosed embodiments are not limited in this regard. It is well known that tungsten carbide (referred to in the industry as matrix) drill bits have a higher moment of inertia than steel body drill bits (since the density of tungsten carbide is about twice that of high-strength steel). Notwithstanding, in certain embodiments that are particularly susceptible to HFTO, it may be advantageous to modify a matrix body drill bit to further increase the polar moment of inertia of the bit and to decrease the susceptibility to HFTO.

Figure 6:
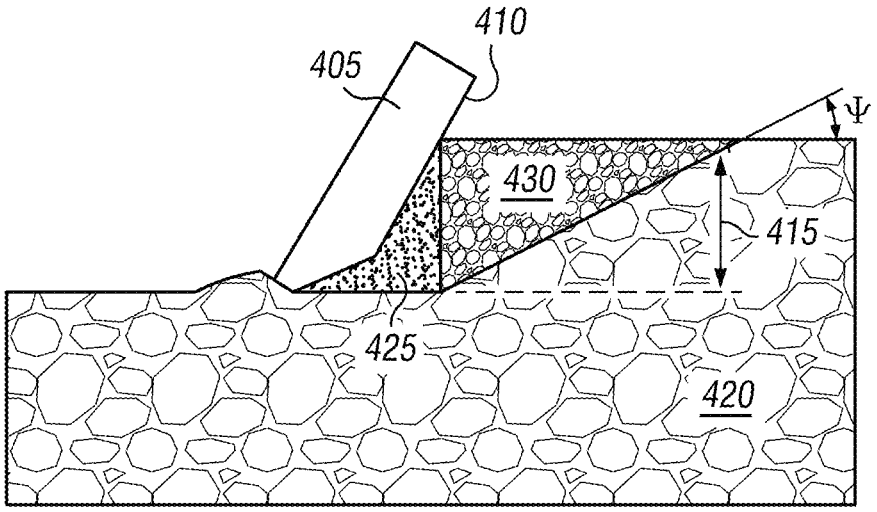
FIG. 6 depicts a schematic illustration of a drill bit cutting element interacting with formation rock.

Turning now to FIG. 6, a schematic illustration of a drill bit cutting element 405 interacting with formation rock 420 is depicted. In the depicted illustration, the cutting element 405 crushes and chips the formation rock 420 during a drilling operation. Example crushed rock 425 and chipped rock 430 is depicted. In general, the particular cutting dynamics may be related to the angle 410 that the cutting element 405 makes with the formation rock 420, the depth of cut 415, the rotational speed of the drill bit (and the cutting element), the force applied to the formation rock by the cutting element (e.g., from the applied torque to the bit), and various properties of the formation rock 420 (among a host of parameters). It has been observed, that during a drilling operation the force applied by the cutting element tends to increase and decrease, increasing as the cutting element engages virgin rock and sharply decreasing as a cuttings chip is released (breaks free from the formation).

As noted above, one aspect of the disclosed embodiments was the realization that HFTO is often caused by the interaction of the drill bit with the formation such that harder and stiffer formations (such as limestone) often cause more severe HFTO than softer more pliable formations (such as sandstone). In other words, it was realized that HFTO may be driven by the elastic (compressible) nature of the rock as the cutter engages with the rock and the force is increasing and then decreasing and the corresponding torsional harmonics that develop from the increasing and decreasing cutter force. Considering that the length of the chip is $x_0$ and that the cutter assembly has mass m and velocity v then the transient cutting force $F_c$ may be written as follows:

$$F_c = \frac{x}{x_0} F_{cmax}$$

where x represents the position of the cutting element and $F_{c\,max}$ represents the force at chip release (i.e., the max force that breaks the chip free). As the force on the cutter increases the speed slows as follows:

$$F_c = -m\frac{dv}{dt}$$

where v represents the velocity and m represents the mass of the cutting element. Assuming the change in velocity Δv is small, yields:

$$\Delta v = -\frac{F}{m}\Delta t$$

$$\Delta t = \frac{x_0}{v - \Delta v/2}$$

such that:

$$\Delta v(v - \Delta v/2) = \frac{-F_{cmax}}{m} x_0$$

In the torsional domain, torque T may be given as follows:

$$T = -I\frac{d\omega}{dt}$$

where I represents the polar moment of inertia and ω represents the rotary speed. Moreover, torque may also be given as follows:

$$T = rF_c$$

where r represents the cutter radius, such that:

$$\Delta\omega(\omega - \Delta\omega/2) = \frac{-F_{cmax}}{I} x_0$$

The polar moment of inertia/may be given as follows:

$$I = \rho\pi\frac{r_{bit}^4 t}{2}$$

where t represents the length of the bit and collar which are energized by the HFTO, $r_{bit}$ represents the bit body radius, and ρ represents the density of the material of the bit body such that:

$$\Delta\omega(\omega - \Delta\omega/2) = \frac{-2F_{cmax}}{\rho\pi r_{bit}^4 t} x_0$$

Note that when p, t, and/or $r_{bit}$ are large then Δω is smaller and hence HFTO is reduced, where Δω or may be thought of as being related to an HFTO amplitude.

It will be appreciated that the cutting force $F_c$ is related to the rock strength (or compressive rock strength) and may be expressed, for example, as follows:

$$F_c = k\sigma S^{\alpha} H^{\gamma}$$

where k is a coefficient, $\sigma$ represents the rock strength, S represents the arc length of the cutting area of each cutter, and H represents an equivalent cutting height H=A/S, where A represents the cutting area for each cutting element. The subscripts $\alpha$ and $\gamma$ are generally formation rock dependent. For example, empirical results for granite indicate that $\alpha \approx 1.5$ and $\gamma \approx 0.5$. By substitution and where $x_0 \approx H$:

$$\Delta\omega(\omega - \Delta\omega/2) = \frac{-2k\sigma A^{1.5}}{\rho\pi r_{bit}^4 t}$$

Considering bit scaling where A=ch $r_{hole}$ with c being a constant, $r_{hole}$ representing radius of the hole, and h representing the cutter depth of cut yields:

$$\Delta\omega(\omega - \Delta\omega/2) = \frac{-2k\sigma(ch\, r_{hole})^{1.5}}{\rho\pi r_{bit}^4 t}$$

Based on the foregoing it will be appreciated that to reduce HFTO $$\left(\Delta\omega \text{ or } \Delta\omega\left(\omega - \frac{\Delta\omega}{2}\right)\right)$$

a driller may increase the rotary speed, $\omega$, or make use of a BHA having an increased bit body density $\rho$, increased length t, and/or bit body radius $r_{bit}$. Moreover, the drilling may tend to have increased susceptibility to HFTO when the rock strength $\sigma$, cutter depth h, and/or hole size $r_{hole}$ are large.

Figure 7:
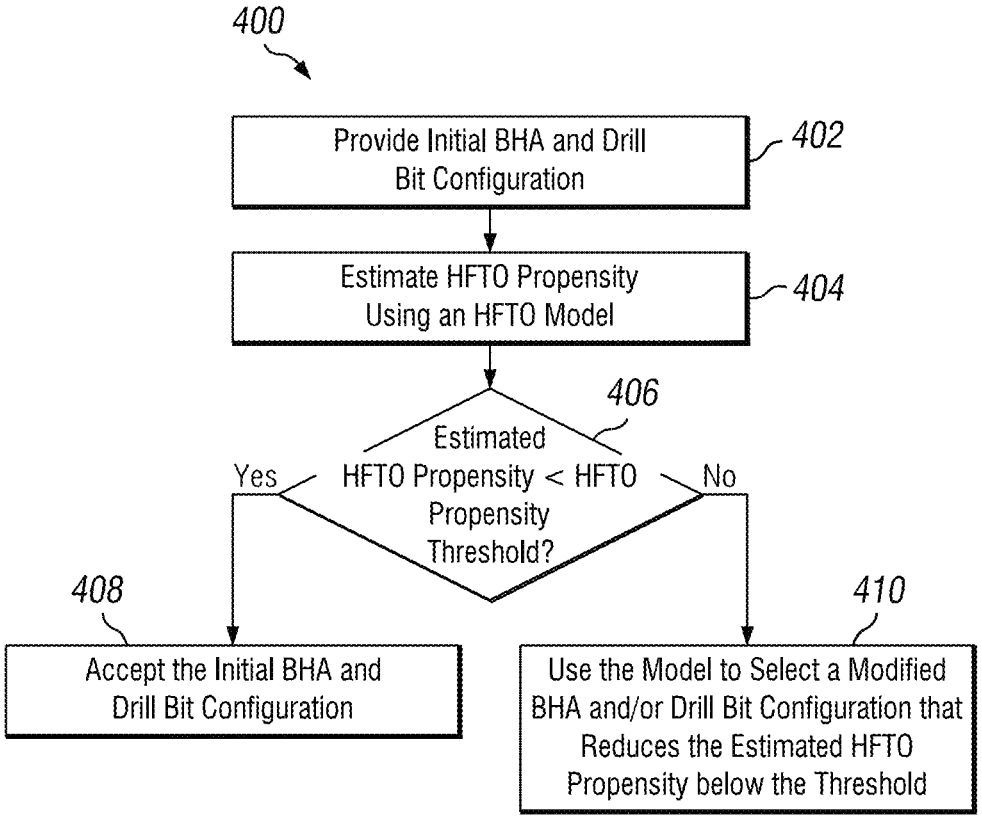
FIG. 7 depicts a flow chart of one example method for configuring a BHA to reduce a propensity for HFTO during a drilling operation.

FIG. 7 depicts a flow chart of one example method 400 for configuring a BHA to reduce a propensity for HFTO during a drilling operation (or for inhibiting HFTO during a drilling operation). The method includes providing an initial BHA and/or drill bit configuration at 402. The provided configuration may be provided based on various considerations known to those of ordinary skill, for example, including hole size, formation characteristics, steering and logging objectives, desired rate of penetration, cost, and etc. An HFTO propensity of the provided BHA and/or drill bit configuration is estimated at 404 using an HFTO propensity model. For example, the HFTO model may be as described above and may relate a propensity for HFTO with various drilling, wellbore, and formation parameters. In one example embodiment, the propensity for HFTO may include a change in a rotary speed $\Delta\omega$ of a drill bit or drill bit cutting element and may increase with increasing rock strength, cutter depth of cut, and/or hole size. The model may further indicate that increasing bit body density, bit or BHA length, and/or bit body radius may reduce the HFTO propensity. The estimated HFTO propensity may be compared with a threshold at 406. The threshold may be selected based on various considerations, but in general represents a maximum level of acceptable HFTO (e.g., maximum $\Delta\omega$) for a candidate drilling operation. The initial (provided) BHA and/or drill bit configuration may be accepted at 408 for the drilling operation when the estimated HFTO propensity is less than the threshold.

The model may be used to select a revised or modified BHA and/or drill bit configuration that reduces the HFTO propensity at 410 when the estimated HFTO propensity is greater than the threshold. For example, the revised or modified BHA and/or drill bit configuration may have an increased polar moment of inertia, such as increased by 25%, 50%, or more as described above. The polar moment of inertia may be increased, for example, by increasing the density of the bit body or the lower BHA body components, by increasing the radius or diameter of the drill bit body, by adding one or more sleeves to the bit body or lower BHA (to increase the effective radii thereof), and/or by selecting a drill bit with an increased cutting blade length. By selecting a new BHA and/or drill bit configuration or by modifying the initial BHA and/or drill bit configuration, the HFTO propensity may be reduced below the threshold and HFTO may be mitigated when the formation and drill bit characteristics previously indicated a strong propensity to HFTO.

It will be understood that the present disclosure includes numerous embodiments. These embodiments include, but are not limited to, the following embodiments.

In a first embodiment, a method for estimating and reducing high-frequency torsional oscillations (HFTO) during a downhole drilling operation comprises providing an initial BHA configuration including an initial drill bit configuration; estimating an HFTO propensity of the initial BHA configuration using a model, wherein the model relates the HFTO propensity to at least a rock strength of a subterranean formation, a radius or diameter of the borehole, a drill bit body density, and a drill bit body radius or diameter; comparing the estimated HFTO propensity with an HFTO propensity threshold; and when the estimated HFTO propensity exceeds the HFTO propensity threshold, use the model to select a modified drill bit or bottom hole assembly (BHA) configuration that reduces the estimated HFTO propensity to a value below the HFTO propensity threshold, wherein the selected modified drill bit or BHA configuration has an increased polar moment of inertia as compared to the initial drill bit or BHA configuration.

A second embodiment may include the first embodiment, further comprising drilling the subterranean borehole with the selected modified drill bit or BHA.

A third embodiment may include any one of the first through second embodiments, wherein the selected modified drill bit configuration has an increased drill bit body density or an increased drill bit body radius as compared to the initial drill bit configuration.

A fourth embodiment may include any one of the first through third embodiments, wherein the increased polar moment of inertia of the selected modified drill bit or BHA configuration is at least 25% greater than a polar moment of inertia of the initial drill bit configuration.

A fifth embodiment may include any one of the first through fourth embodiments, wherein the increased polar moment of inertia of the selected modified drill bit or BHA configuration is at least 50% greater than a polar moment of inertia of the initial drill bit configuration.

A sixth embodiment may include any one of the first through fifth embodiments, wherein the selected modified drill bit configuration has an outer sleeve deployed about a lower shaft portion of the initial drill bit configuration, the outer sleeve providing the increased polar moment of inertia.

A seventh embodiment may include any one of the first through sixth embodiments, wherein the selected modified drill bit configuration has a plurality of blade extenders that extend a length of corresponding drill bit blades, the plurality of blade extenders providing the increased polar moment of inertia.

An eighth embodiment may include any one of the first through seventh embodiments, wherein the BHA comprises a rotary steerable system (RSS) and the selected modified BHA configuration comprises a sleeve deployed about a lower body portion of the RSS, the sleeve providing the increased polar moment of inertia.

A ninth embodiment may include any one of the first through eighth embodiments, wherein the model relates the HFTO propensity to at least a rock strength of a subterranean formation, a rotary speed, a radius or diameter of the borehole, a length of the drill bit and collar that is energized by the HFTO, a cutter depth of cut, a drill bit body density, and a drill bit body radius or diameter.

A tenth embodiment may include the ninth embodiment, wherein the model is expressed mathematically as follows:

$$\Delta\omega(\omega - \Delta\omega/2) = \frac{-2k\sigma(ch\, r_{hole})^{1.5}}{\rho\pi r_{bit}^4 t}$$

wherein $\omega$ represents a rotary speed, $\Delta\omega$ represents a change in the rotary speed and the HFTO propensity, $\sigma$ represents the rock strength of a subterranean formation, h represents the cutter depth of cut, $r_{hole}$ represents the radius of the borehole, $\rho$ represents the drill bit body density, $r_{bit}$ represents the radius of the drill bit, t represents the length of the bit and collar that is energized by the HFTO, and c and k are constants.

In an eleventh embodiment, a bottom hole assembly (BHA) configured for drilling a subterranean wellbore comprises a drill bit coupled to at least one BHA tool, the drill bit including a fixed blade polycrystalline diamond compact (PDC) drill bit, the PDC drill bit including an upper pin end configured for coupling with the BHA tool and a drill bit body having a plurality of cuttings blades extending radially outward from the drill bit body, each of the cutting blades including a plurality of cutting elements deployed thereon; and wherein the PDC drill bit has a gauge diameter dependent polar moment of inertia that is greater than a predetermined gauge diameter dependent inertia threshold such that the BHA exhibits a high frequency torsional oscillation (HFTO) propensity that is below a corresponding HFTO threshold.

A twelfth embodiment may include the eleventh embodiment, wherein the drill bit body comprises a high strength steel drill bit body; and the PDC drill bit has a gauge diameter dependent polar moment of inertia that is greater than a predetermined gauge diameter dependent, high strength steel drill body inertia threshold.

A thirteenth embodiment may include the eleventh embodiment, wherein the drill bit body comprises a matrix drill bit body; and the PDC drill bit has a gauge diameter dependent polar moment of inertia that is greater than a predetermined gauge diameter dependent, matrix drill body inertia threshold.

A fourteenth embodiment may include any one of the eleventh through thirteenth embodiments, wherein the PDC drill bit comprises an outer sleeve deployed about a lower shaft portion of the drill bit, the outer sleeve increasing the polar moment of inertia of the drill bit above the gauge diameter dependent inertia threshold.

A fifteenth embodiment may include any one of the eleventh through fourteenth embodiments, wherein the PDC drill bit comprises a plurality of blade extenders that extend a length of the corresponding cutting blades, the plurality of blade extenders increasing the polar moment of inertia of the drill bit above the gauge diameter dependent inertia threshold.

In a sixteenth embodiment a modified bottom assembly (BHA) configured for drilling a subterranean borehole and for reducing a susceptibility to high-frequency torsional oscillations (HFTO) while drilling, wherein the modified BHA comprises at least a drill bit coupled with a lower BHA tool, wherein the modified BHA has a polar moment of inertia that is at least 25% greater than a polar moment of inertia of the BHA prior to the modification.

A seventeenth embodiment may include the sixteenth embodiment, wherein the polar moment of inertia is at least 50% greater than the polar moment of inertia of the BHA prior to the modification.

An eighteenth embodiment may include any one of the sixteenth through seventeenth embodiments, wherein the drill bit in the modified BHA comprises an outer sleeve deployed about a lower shaft portion of the drill bit, the outer sleeve increasing the polar moment of inertia at least 25%.

A nineteenth embodiment may include any one of the sixteenth through eighteenth embodiments, wherein the lower BHA tool comprises a rotary steerable system (RSS) and the modified BHA comprises an outer sleeve deployed about a lower body portion of the RSS, the outer sleeve increasing the polar moment of inertia at least 25%.

A twentieth embodiment may include any one of the sixteenth through nineteenth embodiments, wherein the drill bit in the modified BHA comprises a plurality of blade extenders that extend a length of corresponding drill bit blades, the plurality of blade extenders increasing the polar moment of inertia at least 25%.

Although increased drill bit or lower BHA inertia for reduced HFTO has been described in detail, it should be understood that various changes, substitutions and alternations can be made herein without departing from the spirit and scope of the disclosure as defined by the appended claims.

We claim:

1. A method for estimating and reducing high-frequency torsional oscillations (HFTO) during a downhole drilling operation, the method comprising:

providing an initial BHA configuration including an initial drill bit configuration;

estimating an HFTO propensity of the initial BHA configuration using a model, wherein the model defines the HFTO propensity as a function of parameters of a polar moment of inertia, a cutter depth of cut of a drill bit, a rotary speed of the drill bit, a rock strength of a subterranean formation, a radius of a subterranean borehole, and one or more constants, wherein the polar moment of inertia is a function of parameters including a radius of the drill bit, a body density of the drill bit, and a length of the drill bit and collar that is energized by the HFTO;

comparing the estimated HFTO propensity with an HFTO propensity threshold; and in response to the estimated HFTO propensity exceeding the HFTO propensity threshold, using the model to select a modified drill bit or bottom hole assembly (BHA) configuration that reduces the estimated HFTO propensity to a value below the HFTO propensity threshold, wherein the selected modified drill bit or BHA configuration has an increased polar moment of inertia as compared to the initial drill bit or BHA configuration, wherein the selected modified drill bit has a gauge diameter between 6.75 inches and 12 inches and the increased polar moment of inertia is greater than 102 lb*in$^2$.

2. The method of claim 1, further comprising drilling the subterranean borehole with the selected modified drill bit or BHA.

3. The method of claim 1, wherein the selected modified drill bit configuration has an increased body density of the drill bit or an increased radius of the drill bit as compared to the initial drill bit configuration.

4. The method of claim 1, wherein the increased polar moment of inertia of the selected modified drill bit or BHA configuration is at least 25% greater than a polar moment of inertia of the initial drill bit configuration.

5. The method of claim 1, wherein the selected modified drill bit configuration has an outer sleeve deployed about a lower shaft portion of the initial drill bit configuration, the outer sleeve providing the increased polar moment of inertia.

6. The method of claim 1, wherein the selected modified drill bit configuration has a plurality of blade extenders that extend a length of corresponding drill bit blades, the plurality of blade extenders providing the increased polar moment of inertia.

7. The method of claim 1, wherein the BHA comprises a rotary steerable system (RSS) and the selected modified BHA configuration comprises a sleeve deployed about a lower body portion of the RSS, the sleeve providing the increased polar moment of inertia.

8. The method of claim 1, wherein the polar moment of inertia is calculated by:

$$I = \rho\pi\frac{r_{bit}^4 t}{2}$$

where $r_{bit}$ is the radius of the drill bit, ρ is the body density of the drill bit, and t is the length of the PDC drill bit and collar that is energized by the HFTO.

9. The method of claim 1, wherein the model is expressed mathematically as follows:

$$\Delta\omega(\omega - \Delta\omega/2) = \frac{-2k\sigma(ch\ r_{hole})^{1.5}}{\rho\pi r_{bit}^4 t}$$

wherein ω represents the rotary speed of the drill bit, Δω represents a change in the rotary speed and the HFTO propensity, σ represents the rock strength of the subterranean formation, h represents the cutter depth of cut of the drill bit, $r_{hole}$ represents the radius of the subterranean borehole, p represents the drill bit body density of the drill bit, $r_{bit}$ represents the radius of the drill bit, t represents the length of the drill bit and collar that is energized by the HFTO, and c and k are the one or more constants.

10. A bottom hole assembly (BHA) configured for drilling a subterranean wellbore, the BHA comprising:

a drill bit coupled to at least one BHA tool, the drill bit including a fixed blade polycrystalline diamond compact (PDC) drill bit, the PDC drill bit including an upper pin end configured for coupling with the BHA tool and a drill bit body having a plurality of cuttings blades extending radially outward from the drill bit body, each of the cutting blades including a plurality of cutting elements deployed thereon, wherein the PDC drill bit has a gauge diameter between 6.75 inches and 12 inches, a polar moment of inertia of greater than 102 lb*in$^2$, and a high frequency torsional oscillation (HFTO) propensity of the BHA below a corresponding HFTO threshold, wherein the polar moment of inertia is a function of parameters including a radius of the PDC drill bit, a body density of the PDC drill bit, and a length of the PDC drill bit and collar that is energized by the HFTO, and wherein the HFTO propensity is a function of the parameters of the polar moment of inertia, a cutter depth of cut of the PDC drill bit, a rotary speed of the PDC drill bit, a rock strength of a subterranean formation, a radius of the subterranean wellbore, and one or more constants.

11. The BHA of claim 10, wherein:

the drill bit body comprises a high strength steel drill bit body.

12. The BHA of claim 10, wherein the PDC drill bit comprises an outer sleeve deployed about a lower shaft portion of the PDC drill bit, the outer sleeve increasing the polar moment of inertia of the PDC drill bit.

13. The BHA of claim 10, wherein the PDC drill bit comprises a plurality of blade extenders that extend a length of the corresponding cutting blades, the plurality of blade extenders increasing the polar moment of inertia of the PDC drill bit.

14. The BHA of claim 13, wherein the plurality of blade extenders are the same width as the corresponding drill bit blade.

15. The BHA of claim 10, wherein the polar moment of inertia is modeled with the equation:

$$\Delta\omega(\omega - \Delta\omega/2) = \frac{-2k\sigma(ch\ r_{hole})^{1.5}}{\rho\pi r_{bit}^4 t}$$

wherein ω represents the rotary speed of the PDC drill bit, Δω represents the change in the rotary speed and the HFTO propensity, σ represents the rock strength of the subterranean formation, h represents the cutter depth of cut of the PDC drill bit, $r_{hole}$ represents the radius of the subterranean wellbore, ρ represents the body density of the PDC drill bit, $r_{bit}$ represents the radius of the PDC drill bit, t represents the length of the PDC drill bit and collar that is energized by the HFTO, and the one or more constants comprise c and k.

16. The BHA of claim 10, wherein the polar moment of inertia is calculated by:

$$I = \rho\pi\frac{r_{bit}^4 t}{2}$$

where $r_{bit}$ is the radius of the PDC drill bit, p is the body density of the PDC drill bit, and t is the length of the PDC drill bit and collar that is energized by the HFTO.

17. A modified bottom hole assembly (BHA) configured for drilling a subterranean borehole and for reducing a susceptibility to high-frequency torsional oscillations (HFTO) while drilling, wherein the modified BHA comprises at least a drill bit with a gauge diameter between 6.75 inches and 12 inches and an additional annular mass coupled with a lower BHA tool, wherein the modified BHA has a polar moment of inertia that is greater than 102 lb*in$^2$, wherein the polar moment of inertia is a function of parameters including a radius of the drill bit, a body density of the drill bit, and a length of the drill bit and collar that is energized by the HFTO, and wherein the HFTO propensity is a function of the parameters of the polar moment of inertia, a cutter depth of cut of the drill bit, a rotary speed of the drill bit, a rock strength of a subterranean formation, a radius of the subterranean borehole, and one or more constants.

18. The modified BHA of claim 17, wherein the additional annular mass in the modified BHA comprises an outer sleeve deployed about a lower shaft portion of the drill bit, the outer sleeve increasing the polar moment of inertia at least 25%.

19. The modified BHA of claim 17, wherein the lower BHA tool comprises a rotary steerable system (RSS) and the additional annular mass in the modified BHA comprises an outer sleeve deployed about a lower body portion of the RSS, the outer sleeve increasing the polar moment of inertia at least 25%.

20. The modified BHA of claim 17, wherein the drill bit in the modified BHA comprises a plurality of blade extenders that extend a length of corresponding drill bit blades, wherein the plurality of blade extenders are the same width as the corresponding drill bit blade.

* * * * *